US005881739A

United States Patent [19]

Walker et al.

[11] Patent Number: 5,881,739

[45] Date of Patent: Mar. 16, 1999

[54] HAIR CRIMPER

[75] Inventors: Anthony John Walker; William Lai Kuen Louey; Gregory John McDougall, all of Hong Kong, Hong Kong

[73] Assignee: Worldtrade Technology Limited, Hong Kong, Hong Kong

[21] Appl. No.: 873,547

[22] Filed: Jun. 12, 1997

[30] Foreign Application Priority Data

Jun. 18, 1996 [GB] United Kingdom ..... 9612681

[51] Int. Cl.[6] ..... A45D 1/00; A45D 2/40

[52] U.S. Cl. ..... 132/224; 132/271; 132/118

[58] Field of Search ..... 132/118, 136, 132/137, 138, 224, 225, 229, 232, 269, 271, 129; 219/222, 225, 226, 230

[56] References Cited

U.S. PATENT DOCUMENTS

| | | | |
|---|---|---|---|
| 1,002,942 | 9/1911 | Taylor | 132/129 |
| 1,197,264 | 9/1916 | Cobb | 132/138 |
| 1,578,566 | 3/1926 | Watson | 132/136 |
| 1,756,104 | 3/1930 | Stone | 132/224 |
| 1,858,851 | 5/1932 | Buchanan | 132/136 |
| 4,126,143 | 11/1978 | Schroeder | 132/118 |
| 4,139,014 | 2/1979 | Rowland | 132/118 |
| 4,243,061 | 1/1981 | Buchanan | 132/118 |
| 4,739,151 | 4/1988 | Smal | 219/225 |
| 4,753,251 | 6/1988 | Guerard et al. | 132/38 |
| 4,917,078 | 4/1990 | Zaborowski | 126/409 |

FOREIGN PATENT DOCUMENTS

| | | |
|---|---|---|
| 0-346-067 | 12/1989 | European Pat. Off. . |
| 263084 | 9/1927 | United Kingdom . |

*Primary Examiner*—Gene Mancene
*Assistant Examiner*—Pedro Philogene
*Attorney, Agent, or Firm*—Miller, Sisson, Chapman & Nash, P.C.

[57] ABSTRACT

A heatable hair crimper has a hollow handle and a comb formed of metallic prongs in rows and columns. Alternate rows are mounted to a metal base plate heated by a pad. When a plunger is squeezed the plate is moved so that hair extending across the comb in the columns is formed and held in tortuous paths while heat is applied via the prongs. Jointed levers are disposed within the hollow handle and are straightened by squeezing action on the plunger.

7 Claims, 2 Drawing Sheets

HAIR CRIMPER

BACKGROUND OF THE INVENTION

1. Field of the Invention

The invention relates to hair crimpers.

2. Description of Prior Art

Hair crimpers are known for imparting curls or waves to strands or bundles of hair to make the hair more attractive or a head of hair easier to shape. Often the presently known crimpers incorporate heating elements that lie along inside the crimping elements and heat is used to deform (that is, wave or crimp) the hair. Such heated crimpers are relatively clumsy and are especially unsuitable for crimping hair close to the scalp. This is one short-coming that makes present crimpers unable to "bulk" hair adjacent the scalp as required for many desirable hair styles.

SUMMARY OF THE INVENTION

It is an object of the invention to overcome or at least to reduce this problem.

According to the invention there is provided a heatable hair crimper having a handle and adjacent one end of the handle a comb formed of rows and columns of heat conductible material prongs, at least one row of the prongs being mounted to an electrical heatable base plate, and a manually operable plunger arranged to move the base which supports one or more alternate rows of the prongs so as to move those prongs relative to the other prongs and to form and hold strands of hair previously gathered between the columns in tortuous paths through the comb.

The heatable base plate may be arranged to be heated by an electric heating pad extending over and in contact with one of the major surfaces of the plate.

There are preferably five rows and four columns of prongs.

At each side of the comb there is preferably provided an outer row of prongs formed of non-conductive material.

Each alternative row of prongs is preferably arranged to move in a direction transverse to the longitudinal axes of the prongs.

The other prongs may be supported with their ends in sliding contact with the heatable base plate. A second heatable base plate may be provided to which the other prongs are mounted, the second heatable base plate being in slidable contact with the first heatable plate.

BRIEF DESCRIPTION OF THE DRAWINGS

Hair crimpers according to the invention will now be described by way of example with reference to the accompanying schematic drawings in which.

DESCRIPTION OF THE PREFERRED EMBODIMENT

Figure 1:
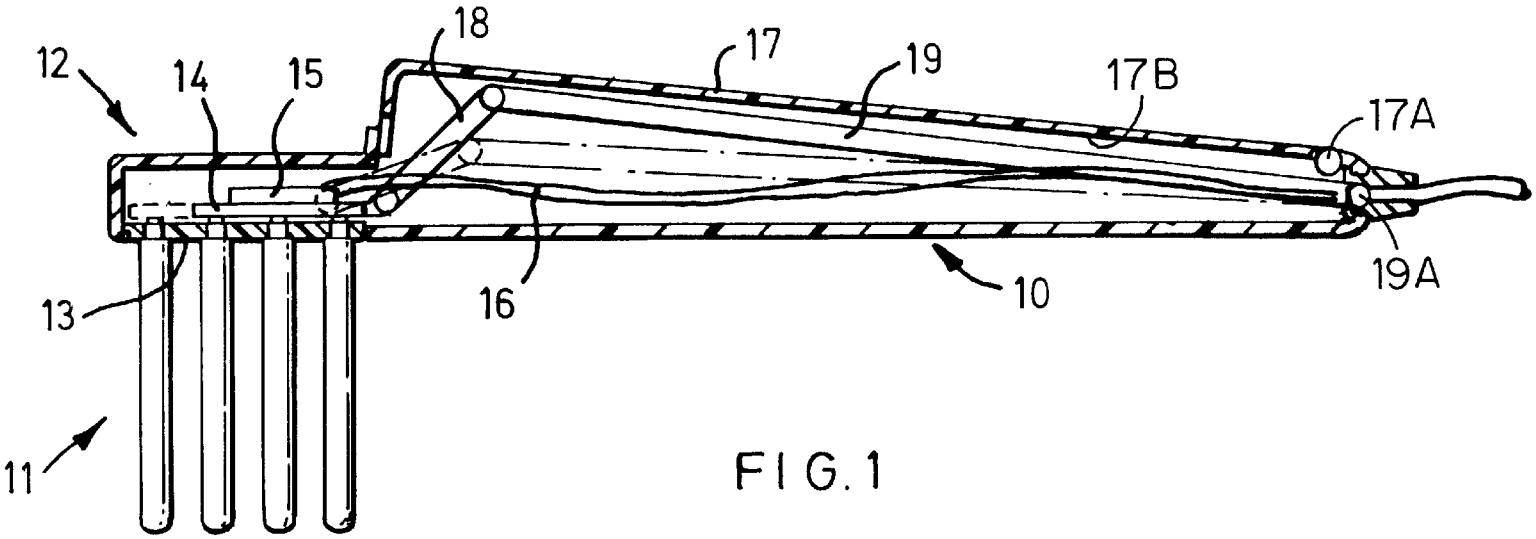
FIG. 1 is a sectional side view of one crimper.

Referring to the drawings, the crimper comprises a handle 10 and a comb 11 formed of rows and columns of metallic prongs extending down from adjacent one end 12 of the handle. Some of the prongs are rigidly supported in a metal plate 13 fixed in the end 12 of the handle 10. Two rows of the prongs are rigidly fixed in a movable metal plate 14, as described below. An electric heating pad 15 is mounted on the top of the plate 14 and supplied via electric cables 16 from a mains supply. Heat generated by the pad 15 is conducted to and along the prongs by mechanical contact between the pad 15 and the plates 13 and 14.

It is however possible to form the plate 13 of non-conductive material, in which case the heat is conducted to the ends of the prongs that extend through and beyond the top surface of the plate 13. In this manner, the heat is conducted to these prongs via the sliding contacts of their ends with the plate 14.

A pivoted plunger 17 is mounted to the hollow handle 10 and biassed by a spring (not shown). When the plunger is pressed or "squeezed" against its bias, pivotably, jointed levers 18 and 19 housed within the handle 10 are caused straighten and urge the plate 14 in a direction transverse to the longitudinal axes of the prongs from a first operative shown in FIG. 1 to a second operative position shown dotted in the Figure. The plunger pivot 17A is spaced apart from the remote end 19A pivotally attached to the hollow handle 10 When the plunger 17 is released,inside surface 17B of the the plunger lifts up and away from the jointed levers and the plate 14 moves back to its first operative position.

Figure 2:
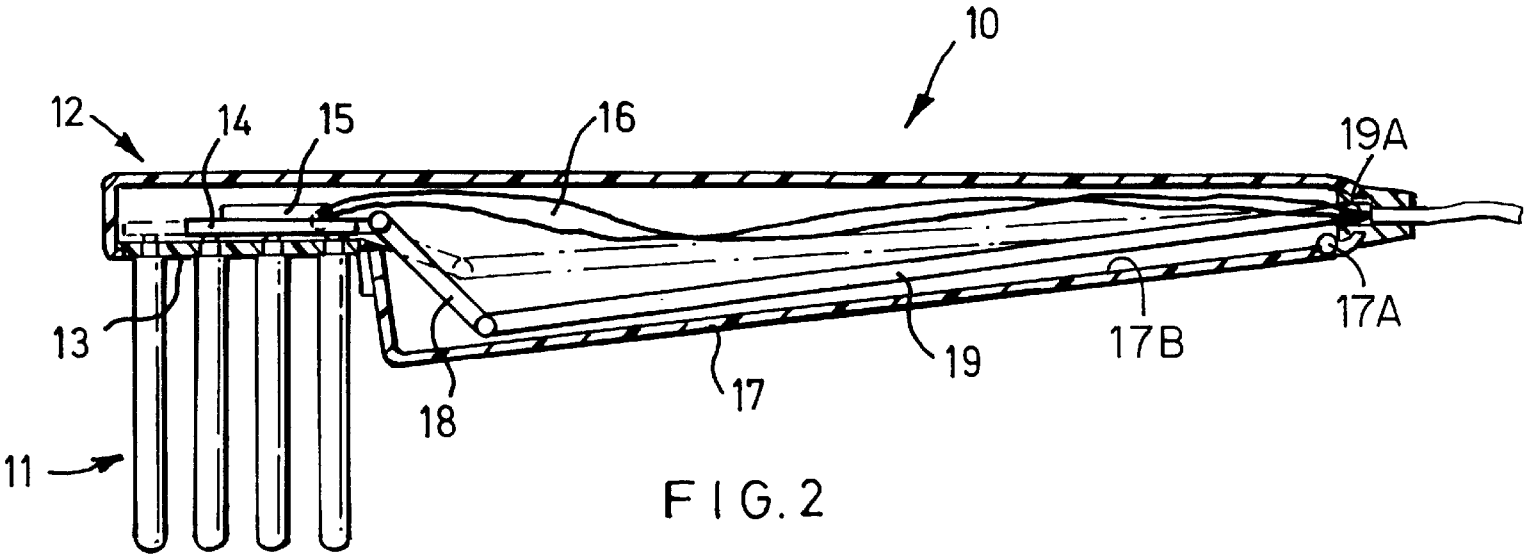
FIG. 2 is a sectional side view of another crimper.

In FIG. 2, the crimper is generally the same as shown in FIG. 1 except that the plunger 17 is mounted one the underside of hollow handle 10.

Figure 3:
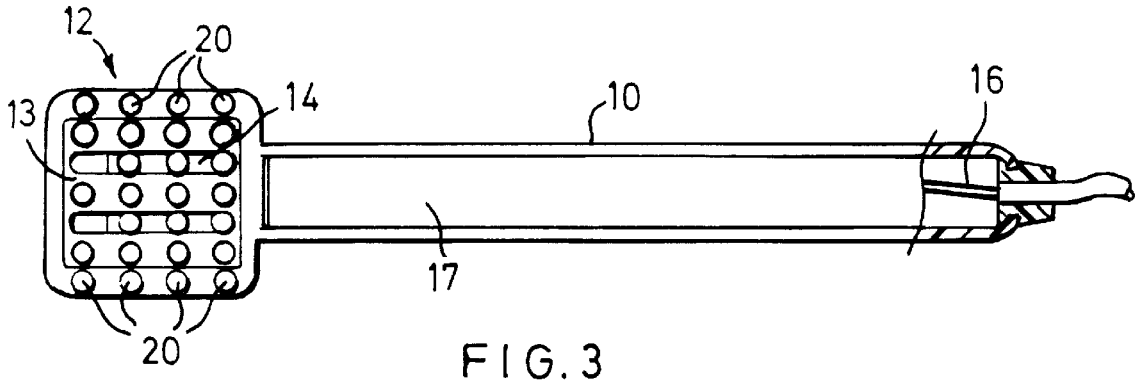
FIG. 3 is bottom plan view of the crimper of FIG. 2.
Figure 4:
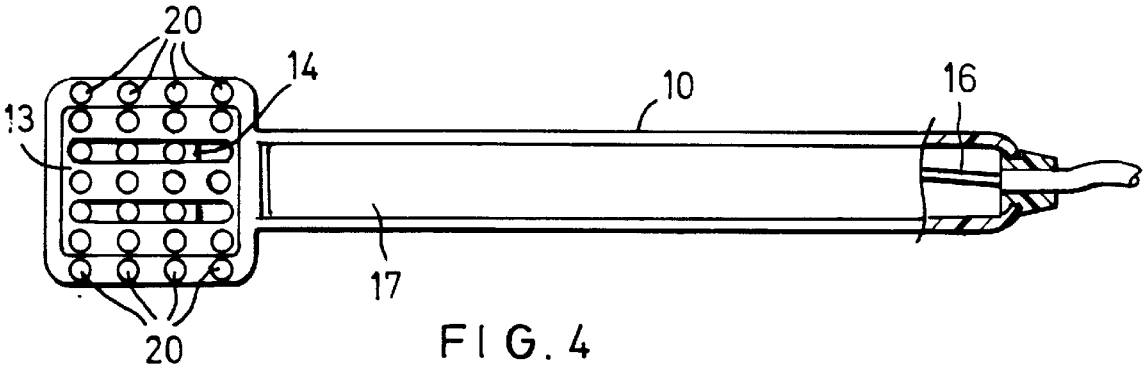
FIG. 4 is a bottom plan view of the crimper of FIG. 2 with its prongs in a different operative position.

In FIGS. 3 and 4, prongs that make up the comb are shown in more detail. The metallic prongs are arranged in five rows and four columns. An extra row of similar shaped prongs 20, which are formed of plastics material, are provided adjacent the exterior rows of metal prongs. In practice, the plastic prongs do not get as hot as the metal prongs and so it is not possible, or less likely, that too much heat will be applied directly to the scalp. In other words, when the prongs of the crimper are presented to the head of the user, actual contact between the scalp and the crimper will occur generally in normal use only with the remote ends of plastic prongs 20 and not with the metal prongs.

Figure 3A:
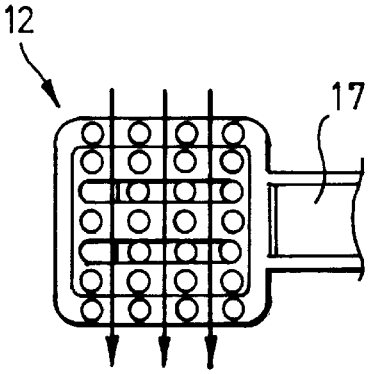
FIG. 3A is a view of part of FIG. 3.
Figure 4A:
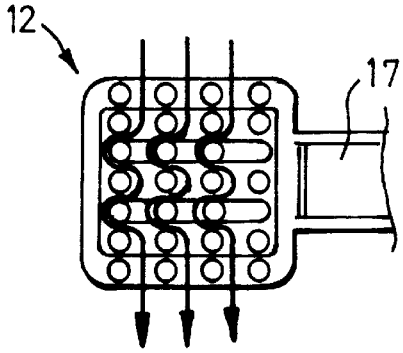
FIG. 4A is a view of part of FIG. 4.

FIG. 3 shows the crimper in the first operative position and FIG. 4 shows the crimper in the second operative position. The corresponding FIGS. 3A and 4A show strands of hair placed in the crimper. In FIG. 3A, the hair lies generally straight between each column of prongs where it has been gathered by combing the head to collect up the hair. It will be appreciated that the described crimpers can readily collect hair adjacent its roots, that is adjacent the scalp. In use, once the desired hair strands are located in the comb, the plunger 17 is depressed to form the hair into the tortuous paths shown in FIG. 4A. The heat in some or all of the metallic prongs, as the case may be, is transferred to the hair while the hair held by the crimper for usually about 10 to 15 seconds. The plunger 17 is then released and the hair allowed to lift out of the comb 11. The hair then retains a set or crimp.

Other mechanical means may be used to move the plate 14 backwards and forwards but generally the plunger 17, or equivalent, should be arranged to be operated by squeezing, or by a finger or thumb of a same hand that holds the handle 10. The number of rows or columns of prongs may be increased, although the described arrangements are preferred.

It will be noted that the metallic prongs are somewhat rectangular in cross-section, although they have rounded corners. The shape or similar as actually shown provides some practical advantages in the crimping operation, where each of the prongs have a somewhat greater dimension in the direction of crimping.

We claim:

1. A heatable hair crimper having a hollow handle with a longitudinal axis and adjacent one end of said handle a comb formed of rows and columns of heat conductible prongs, at least one row of said prongs being mounted to an electrical heatable base plate, and a manually operable plunger pivoted at one end to said handle adjacent said longitudinal axis, two pivotably connected jointed levers mounted within said hollow handle adjacent said plunger and pivotably connected at remote ends to said base plate and said handle respectively said plunger pivot spaced apart from said remote end of said jointed lever attached to said handle and arranged such that when said plunger is pivoted toward the inside of said hollow handle an inner surface of said plunger bears upon and straightens said jointed levers towards said longitudinal axis to move said base plate supporting first alternate rows of said prongs along said longitudinal axis so as to move said alternative rows of prongs relative to and between other of said prongs to form and hold strands of hair gathered between said columns into tortuous paths through said comb.

2. A heatable hair crimper according to claim 1, in which the heatable base plate is arranged to be heated by an electric heating pad extending over and in contact with one of the major surfaces of the plate.

3. A heatable hair crimper according to claim 1, in which there are five rows and four columns of prongs.

4. A heatable hair crimper according to claim 1, including at each side of the comb an outer row of prongs formed of non-conductive material.

5. A heatable hair crimper according to claim 1, in which each alternative row of prongs is arranged to move in a direction transverse to the longitudinal axes of the prongs.

6. A heatable hair crimper according to claim 1, in which the other prongs are supported with their ends in sliding contact with the heatable base plate.

7. A heatable hair crimper according to claim 1, including a second heatable base plate to which the other prongs are mounted, the second heatable base plate being in slidable contact with the first heatable plate.

* * * * *